US005662488A

United States Patent [19]

Alden

[11] Patent Number: 5,662,488

[45] Date of Patent: Sep. 2, 1997

[54] QUICK CONNECT COUPLING SYSTEM FOR RAPIDLY JOINING CONNECTORS AND/OR OTHER ELONGATED BODIES

[76] Inventor: Peter H. Alden, P.O. Box 375, N. Easton, Mass. 02356

[21] Appl. No.: 742,245

[22] Filed: Oct. 31, 1996

[51] Int. Cl.[6] ..... H01R 4/54

[52] U.S. Cl. ..... 439/314; 439/315

[58] Field of Search ..... 439/311–319, 345

[56] References Cited

U.S. PATENT DOCUMENTS

| | | | |
|---|---|---|---|
| 2,272,606 | 2/1942 | Herriger | 439/378 |
| 3,094,364 | 6/1963 | Lingg | 439/247 |
| 3,513,436 | 5/1970 | Nodfelt | 439/314 |
| 3,601,764 | 8/1971 | Cameron | 439/315 |
| 3,665,371 | 5/1972 | Cripps | 439/319 |
| 3,754,206 | 8/1973 | Obeissart | 439/319 |
| 3,835,443 | 9/1974 | Arnold et al. | 439/319 |
| 3,869,186 | 3/1975 | Vetter | 439/321 |
| 3,901,574 | 8/1975 | Paullus et al. | 439/315 |
| 3,917,373 | 11/1975 | Peterson | 439/321 |
| 3,947,081 | 3/1976 | Peterson | 439/315 |
| 4,068,911 | 1/1978 | Lodato et al. | 439/319 |
| 4,239,315 | 12/1980 | Lacaze, Jr. | 439/312 |
| 4,487,470 | 12/1984 | Knapp et al. | 439/312 |
| 4,519,661 | 5/1985 | Brush, Sr. et al. | 439/312 |
| 4,534,607 | 8/1985 | Tomsa | 439/312 |
| 4,737,119 | 4/1988 | Stieler | 439/318 |
| 4,820,185 | 4/1989 | Moulin | 439/321 |
| 5,167,522 | 12/1992 | Behning | 439/315 |
| 5,189,788 | 3/1993 | Sakai et al. | 29/842 |
| 5,190,478 | 3/1993 | Colleran | 439/595 |
| 5,195,911 | 3/1993 | Murphy | 439/607 |
| 5,211,571 | 5/1993 | Comstock et al. | 439/352 |
| 5,217,385 | 6/1993 | Inoue et al. | 439/353 |
| 5,217,390 | 6/1993 | Nozaki et al. | 439/489 |
| 5,219,300 | 6/1993 | Yagi et al. | 439/532 |
| 5,246,380 | 9/1993 | Kodama | 439/354 |
| 5,252,096 | 10/1993 | Okada | 439/752 |
| 5,272,445 | 12/1993 | Ehrenfels et al. | 439/134 |
| 5,277,599 | 1/1994 | Nilson | 439/133 |
| 5,292,258 | 3/1994 | Sakurai | 439/352 |
| 5,330,366 | 7/1994 | Tsuji et al. | 439/352 |
| 5,330,369 | 7/1994 | Nozaki et al. | 439/489 |
| 5,334,041 | 8/1994 | Anbo et al. | 439/358 |
| 5,366,383 | 11/1994 | Dearman | 439/321 |
| 5,389,013 | 2/1995 | Kourimsky | 439/746 |

(List continued on next page.)

FOREIGN PATENT DOCUMENTS

| | | |
|---|---|---|
| 1552474 | 1/1969 | France . |
| 4039240 | 3/1990 | Germany . |
| 4026840 | 8/1990 | Germany . |
| 315457 | 7/1929 | United Kingdom . |
| 2136641 | 9/1984 | United Kingdom . |

*Primary Examiner*—Hien Vu

*Attorney, Agent, or Firm*—Steven N. Fox, Esq.

[57] ABSTRACT

A connector system comprising a first connector body comprising a housing and a collar. The housing comprising at least one cam recess having an innermost portion and an outermost portion. The collar comprises a first end having at least one engagement boss and a second end having at least one rotational rib member which is elastically deformable. The rotational rib member comprises a cam follower portion. The collar being resistingly rotatable about the housing as the cam follower portion is slidingly moveable from the innermost portion to the outermost portion of the cam recess causing the rotational rib member to become increasingly elastically deformed. The connector system further comprises a second connector body comprising at least one engagement recess having a tapered wall portion and a locking portion. The first connector body being telescopingly engagable with the second connector body from a first position wherein the engagement boss is in contact with the tapered wall portion and the cam follower portion is positioned at the uppermost portion of the cam recess to a second position wherein the engagement boss is not in contact with the tapered wall and is snapped into locked engagement within the locked portion. To disengage the first and second connector bodies, the collar must be manually counter-rotated whereby the engagement boss may be removed from the engagement recess.

5 Claims, 3 Drawing Sheets

U.S. PATENT DOCUMENTS 5,389,014 2/1995 Kiimpel et al. ..... 439/752
5,391,090 2/1995 Power ..... 439/354
5,409,394 4/1995 Astier ..... 439/347
5,429,527 7/1995 Nozaki et al. ..... 439/489
5,435,605 7/1995 Koumatsu et al. ..... 285/110
5,439,386 8/1995 Ellis et al. ..... 439/322
5,462,448 10/1995 Kida et al. ..... 439/357
5,482,476 1/1996 Watanabe et al. ..... 439/555

QUICK CONNECT COUPLING SYSTEM FOR RAPIDLY JOINING CONNECTORS AND/OR OTHER ELONGATED BODIES

FIELD OF THE INVENTION

The present invention relates generally to a system for joining a first connector body with a second connector body.

BACKGROUND OF THE INVENTION

After mating two connectors of any type, including electrical, fluidic, mechanical or optical, it is often desirable and necessary to lock the two connector bodies together to prevent the accidental disconnection of the connectors. U.S. Pat. No. 5,167,522 discloses a connector system whereby two connector bodies may be telescopingly engaged and snap locked into a locked position. Systems of the type exemplified by U.S. Pat. No. 5,167,522 have several drawbacks. Such systems use numerous mechanical components, including springs which increase the complexity and cost of assembly and are susceptible to malfunction due to the sensitivity of this type of configuration. Over extended time and usage these devices can degrade and/or otherwise cause the connector system to become inoperable. These devices are also subject to damage from impact, crushing or over torquing of the rotating mechanisms.

SUMMARY OF THE PRESENT INVENTION

It is an object of the present invention to provide an improved system for joining a first connector body with a second connector body which minimizes the use and number of mechanical components such as springs.

It is another object of the invention to provide a connector system that is robust, cost-effective and simple to manufacture and which provides for quick one-handed mating with user confirmation of positive locked engagement.

The present invention is a system for joining a first connector body with a second connector body. The connector bodies may take many forms, including that of electrical, fluidic, mechanical, and optical connectors. In one embodiment, the first connector body is generally a male or plug connector having a plurality of terminal pins while the second connector body is a female or receptacle connector having a plurality of terminal sockets.

The male connector generally comprises a cylindrical shaped housing and an encircling cylindrical shaped collar. The housing generally comprises a plurality of radial shaped cam recesses and radially shaped axial retention recesses formed about the exterior surface of the housing. Each of the cam recesses have a non-uniform radial depth and are ramped radially upward from an innermost portion to an outermost portion. Each of the axial retention recesses have a constant radial depth. The housing further comprises a key(s) formed along the interior surface of the housing. The collar generally comprises a first end formed with a plurality of flexible rotational rib members and a plurality of axial retention rib members. Each of the rotational rib members have a cam follower which are adapted to move slidingly within their corresponding cam recess to provide a counter-rotation spring force which resists rotation of the collar relative to the housing. Each of the axial retention rib members have an engagement boss that are adapted to move slidingly within their corresponding axial retention recess to provide axial retention (nonaxial movement) of the collar relative to the housing while allowing unrestrained rotational movement of the collar. The collar further comprises a second end having a plurality of engagement bosses adapted to engage with corresponding engagement recesses formed on the exterior housing of the female connector.

The female connector generally comprises a cylindrical shaped housing having a plurality of engagement recesses formed about the exterior surface of the housing. Each of the engagement recesses have a tapered wall and a locking portion terminating at an end wall. The housing further comprise a key-way(s) positioned along the interior of the housing.

To engage the male and female connectors, the user may align the key(s) of the male connector and key-way(s) of the female connector by aligning the external visual indicators whereby the engagement bosses of the male connector are also brought into alignment with the engagement recesses of the female connector. The telescopingly axial engagement of the male and female connectors causes the engagement bosses to contact tapered wall. Axial movement of the engagement bosses along the tapered wall causes the collar to rotate with respect to the male and female connector which in turn causes the cam followers to move from the innermost portion to the outermost portion of the cam recess. Movement of the cam followers from the innermost portion to the outermost portion of the cam recesses causes the rotational rib members to become increasingly elastically deformed and torsionally flexed whereby a counter-rotation force is inherently applied to the collar. This counter-rotation force is opposed by the bearing force applied to the collar as a result of the engagement bosses being in contact with the tapered wall of the engagement recess. Upon complete axial engagement of the male and female connectors, the engagement bosses lose contact with the tapered wall and the engagement bosses are forcibly driven into engagement with the locking portion and against the end wall of the engagement recess driven by the stored counter-rotation force of the rotational rib members. The rapid motion of the engagement bosses into the locking portion and subsequent striking of the end wall emits an audible "click" thereby providing the user with confirmation that full mating and locked engagement of the male and female connectors has occurred. In this fully locked engaged position, the rotational rib members cannot return to their completely undeformed state and as such continue to apply a slight counter-rotation force to the collar thereby holding the engagement bosses in bearing contact with the locking portion and against the end wall. Maintaining this slight counter-rotation force prevents accidental disconnection of the connectors due to shock and/or vibration conditions. To disengage the connectors, the collar may be manually rotated to a position whereby the engagement bosses can be removed from the engagement recesses.

BRIEF DESCRIPTION OF THE DRAWINGS

The following detailed description of the present invention will be better understood with reference to the accompanying drawing in which:

FIG. 2 is an end view of the male connector;

DETAILED DESCRIPTION OF THE PREFERRED EMBODIMENTS

The present invention is a system for joining a first connector body with a second connector body. The connector bodies may take many forms, including that of electrical, fluidic, mechanical, and optical connectors.

Figure 1:
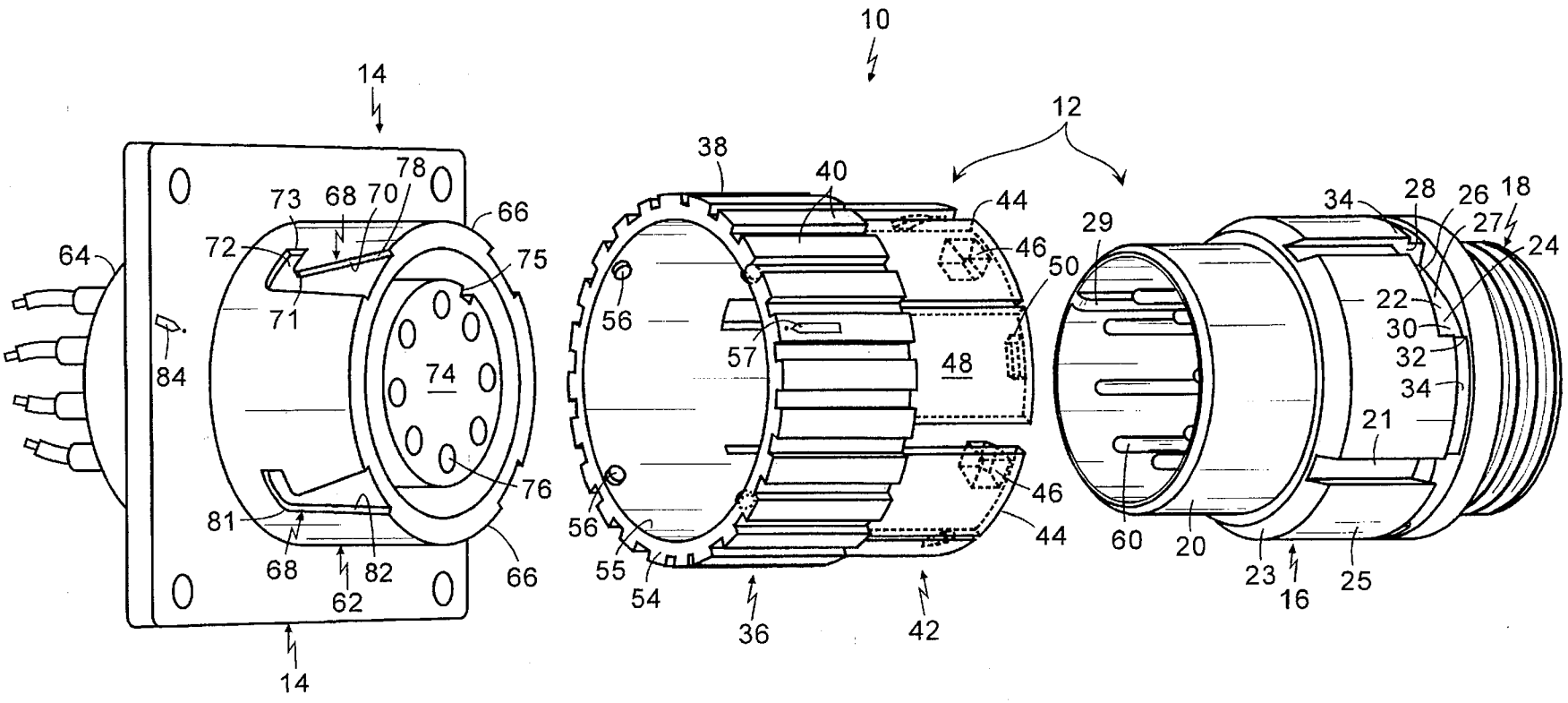
FIG. 1 is an exploded perspective view of the present invention.
Figure 2A:
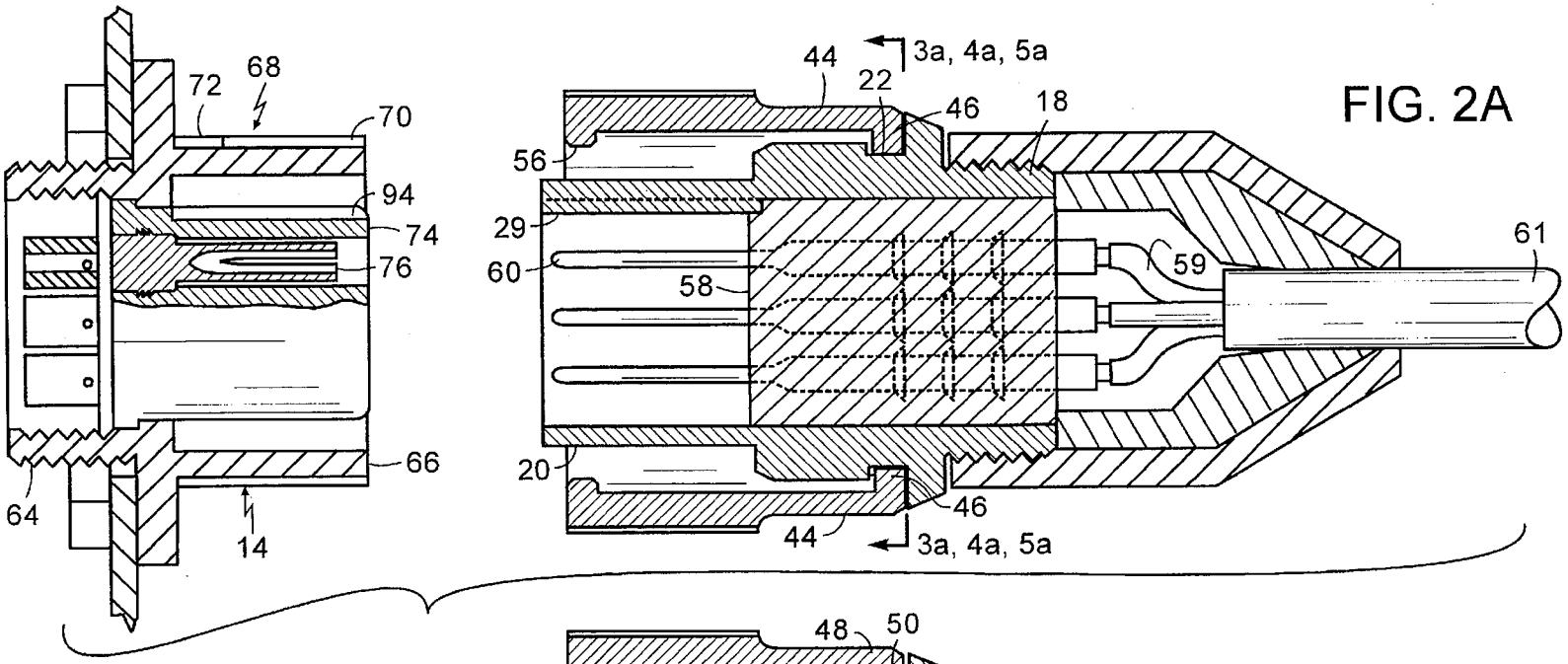
FIGS. 2A and 2B are cross-section views taken along line 2A and 2B, respectively, of FIG. 2.
Figure 2B:
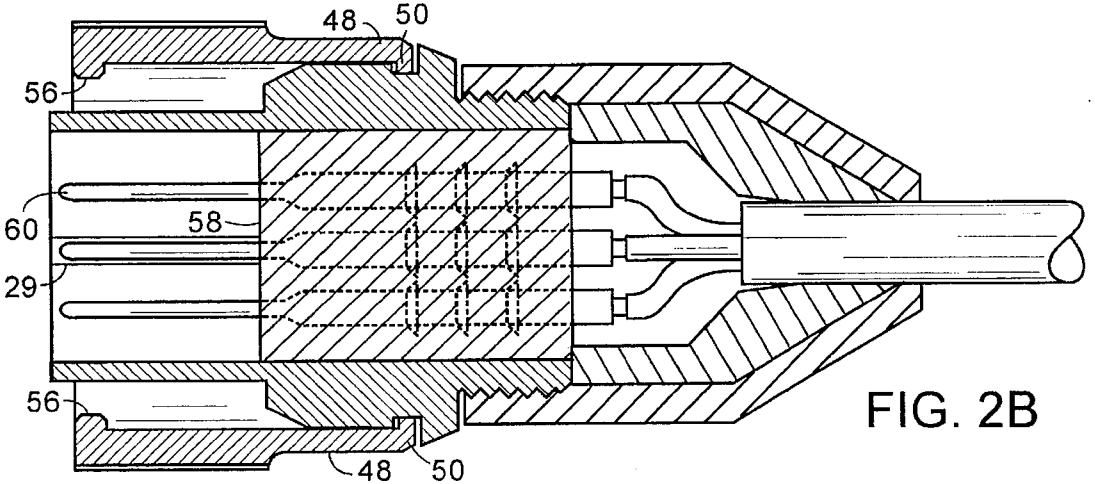

Referring to FIGS. 1 and 2, where one embodiment of the connector system 10 of the present invention is shown generally comprising a male plug connector 12 and a female receptacle connector 14. The male connector 12 generally comprises a cylindrical shaped housing 16 and a cylindrical shaped collar 36. The housing 16 is formed with a first end 18, a second end 20, and an external median portion 25. A plurality of radial shaped cam recesses 22 are formed about the median portion 25 of the housing 16. Each of the cam recesses 22 have a non-uniform radial depth and comprise a radial ramp 24 defined by an innermost portion 26 abutting an innermost end wall 28 and continuously extending upward to an outermost portion 30 abutting an outermost end wall 32. The housing 16 further comprises a plurality of retention recesses 34 having a constant radial depth. The housing 16 further comprises a plurality of assembly slots 21 axially disposed along the median portion 25 beginning at a chamfered portion 23 and terminating at each cam recess 22. The housing 16 further comprises an insulating member 58 and a plurality of terminal pins 60 mounted within the insulating member 58. The terminal pins 60 are connected by conventional means (such as crimping) to corresponding electrical wires 59 bundled within a cord 61. The housing 16 further comprises a key 29 extending inwardly from the second end 20 and which is adapted to engage and align with a corresponding key-way 75 (to be described) of the female connector 14 to provide initial alignment of the mating components and upon engagement to restrict any rotational motion of the housing 16 with respect to the female connector 14 during the engagement process. Although only one axially disposed key 29 and key-way 75 are shown, a plurality of keys and corresponding key-ways may be employed having a variety of different configurations and/or positions.

The collar 36 comprises a median portion 38 having a plurality of grooves 40 formed about the exterior surface thereof and adapted so that collar may be gripped by a person. The collar 36 further comprises a visual indicator or marking 57 on the exterior surface of the collar 36. As will be described more fully herein, the visual indicator 57 may be aligned with a corresponding visual indicator 84 (to be described) on the female connector 14 to provide easy and proper alignment of the keys 29 (to be described) of the male connector 12 and key-ways 75 (to be described) of the female connector 14. The collar 36 further comprises a plurality of alternating flexible rotational rib members 44 and axial retention rib members 48 extending from and a first end 42 of the median portion 38. Each of the rotational rib members 44 have a cam follower portion 46 extending inwardly therefrom. Each of the cam follower portions 46 are adapted to engage with and slidingly move (or ride) within and from the innermost portion 26 of their respective cam recess to the outermost portion 30 of their respective cam recess 22. Each of the retention rib members 48 have a retention boss 50 which are adapted to engage with and slidingly move (or ride) within the corresponding retention recess 34. The collar 36 further comprises a plurality of engagement bosses 56 extending inwardly from an inside surface 55 of the median portion 38 and positioned adjacent to the second end 54 of the median portion 38.

The collar 36 is assembled onto the housing 16 by sliding the rib members 44 (along with the cam follower portion 46) and the retention ribs 48 (along with the retention bosses 50) over the second end 20 of the housing 16. As the collar 36 is further engaged, the cam follower portions 46 and the retention bosses 50 are caused to come in contact with the chamfered portion 23 of the housing 16. At this point, the cam follower portions 46 are aligned with the assembly slots 21 for further engagement. The assembly slots 21 provide proper alignment and access for the cam followers 46 to travel into the cam recesses 22 during assembly with the collar 36 without having to over-stress the rotation rib members 44 by minimizing the required radial expansion. As the collar 37 is further engaged, the cam follower portions 46 of each rotational rib 48 are snapped into engagement and become confined within their corresponding cam recess 22. Similarly, the retention bosses 50 of each retention rib members 48 are snapped into engagement and become confined within their corresponding retention recess 34. The retention bosses 50 serve to fasten the collar 36 to the housing 16 and to restrain the collar 36 from any axial motion with respect to the male connector 12 while allowing unrestrained rotational freedom. The retention bosses 50 also serve to absorb any axial loading during mating and allow the cam follower portions 46 freedom from friction due to axial forces.

The rotational rib members 44 having their cam follower portions 46 slidingly moveable within their corresponding cam recess 22 provide a counter-rotation spring force which resists rotation of the collar relative to the housing 16. Specifically, the application of an external force to cause forced rotation of the collar 36 in turn causes each of the cam follower portions 46 to move from their normal position at the innermost portion 26 of the cam recess 22 to the outermost portion 30. As the cam follower portions 46 move from their normal position at the innermost portion 26 of the cam recess 22 to the outermost portion 30 their respective rotational rib members 44 become elastically deformed and torsionally flexed and provide a means for stored kinetic energy in the form of a counter-rotation spring force which resists rotation of the collar 36 relative to the housing 16. Removal of the externally applied rotational force to the collar 36 causes the cam follower portions 46 to slide rotationally inward toward their normal and slightly biased position at the innermost portion 26 of the cam recess 22 and held against the end wall 28 as the spring forces stored within the elastically deformed rotational rib members 44 are relieved. This position corresponds with the alignment of the key 29 and key-way 75 to ensure that the collar 36 is held in a "ready-to mate" position when the male connector 12 and female connector 14 are not engaged.

The female connector 14 generally comprises a housing 62 having a first end 64 and a second end 66. The female connector 14 further comprises a plurality of engagement recesses 68 formed about the exterior surface of the second end 66. The engagement recesses 68 are generally adapted to receive axial engagement of the engagement bosses 56 of the collar 36 while applying an external force to cause rotation of the collar 36, and to thereafter retain the engagement bosses 56. Each of the engagement recesses 68 have a first tapered wall 70 and a locking portion 72. The first tapered wall 70 is defined by an outermost portion 78 and terminates at a transition corner portion 71. The locking portion 72 is a recess slot located axially behind the first tapered wall 70 of the engagement recess 68 and terminates at an end wall 73. The end wall 73 is positioned at a point rotationally outward of the transition corner 71 and inward of the outermost portion 78. As will be described more fully herein, positioning of the end wall 73 inward of the outermost portion 78 is important to ensure that upon full engagement of the connectors 12 and 14, the rotational rib members 44 still retain a residual counter-rotation force to forcibly retain the engagement bosses 50 within the locking portion 72 and against the end wall 73. Each of the engagement recesses 68 further comprise a curved wall portion 81 and a second tapered wall 83. The curved wall portion 81 and the second tapered wall 83 serve to assist in disengaging the male connector 12 from the female connector 14 as the engagement bosses 56 bear against the walls during manual counter-rotation of the collar 36.

The female connector 14 further comprises an insulating member 74 and a plurality of terminal sockets 76 mounted within the insulating member 74. The female connector 14 further comprises a key-way 75 disposed about and running axially along the insulating member 74 and which is adapted to engage with the key 29 of the male connector 12 to provide mating alignment and to restrict any rotational motion of the female connector 14 with respect to the male connector 12 during and after the engagement process. Use of key 25 and of key-way 75 also provides preliminary alignment of the engagement bosses 56 of the collar 36 with the engagement recesses 68 as well as the terminal pins 60 of the male connector 12 with the terminal sockets 76 of the female connector 14. Variations in key/key-way configuration can also be used to provide positive lock-out differentiation between differing internal circuit configurations.

Referring to FIGS. 3A–3B through 5A–5B, wherein the position of the cam follower portions 46 within their corresponding cam recess 22 relative to the position of the engagement bosses 56 within their corresponding engagement recess 66 are shown at points before, during and after complete engagement of the male connector 12 with the female connector 14.

Figure 3A:
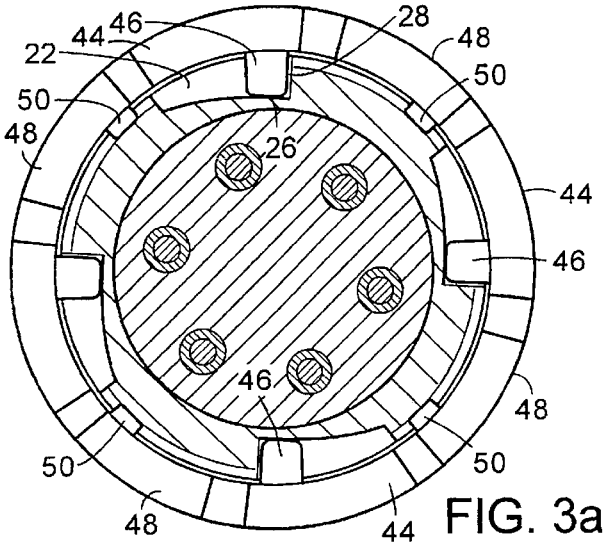
FIGS. 3A and 3B are diagrammatic views showing the position of the cam followers of the rotational rib members of the collar engaged within their respective cam recess of the housing of the male connector relative to the position of the engagement bosses of the collar entering the engagement recess of the female connector at a point just prior to engagement of the connectors. Also shown are the engagement bosses of the axial retention rib members of the collar engaged within their respective axial retention recess.
Figure 3B:
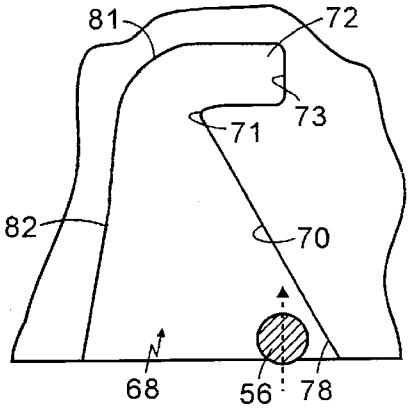

Referring to FIGS. 3A–3B where the position of the cam follower portions 46 within their corresponding cam recess 22 (FIG. 3A) relative to the position of the engagement bosses 56 within their corresponding engagement recess 66 (FIG. 3B) are shown at a point just prior to engagement of the male connector 12 and female connector 14. At this point, each of the engagement bosses 56 are pre-positioned at the lowermost portion 78 of the tapered wall portion 70 of the engagement recess 68 (but not engaged) of the female connector 14 as dictated by the alignment positions of the key 29 and key-way 75 of the male connector 12 and female connector 14, respectively, and further confirmed by the alignment of the external visual indicators 57 and 84 on the collar 36 and female connector 14, respectively. Each of the cam follower portions 46 are positioned at the innermost portion 26 of the cam recess 22 adjacent the innermost end wall 28. In this position, the rotational ribs 44 of the collar 36 are slightly elastically deformed (although not readily apparent from the drawings) and held against end wall 28 to ensure the collar 36 is held in the "ready-to-mate" position when the male and female connectors are not engaged. This "ready-to-mate" position ensures that alignment of the key 29 of the male connector with the key-way 75 of the female connector 14 also dictates alignment of the engagement bosses 56 of the collar 36 with the engagement recess 68 of the female connector 14. Also shown in FIG. 3A are the engagement bosses 50 of the axial retention rib members 48 engaged within their corresponding retention recess 34.

Figure 4A:
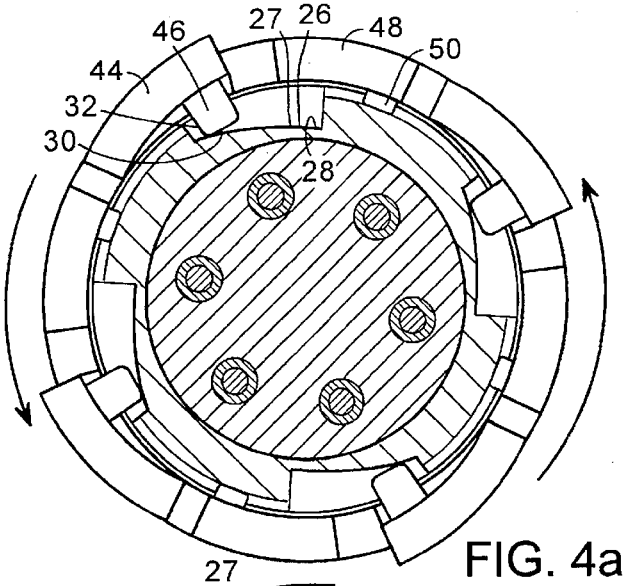
FIGS. 4A and 4B are diagrammatic views showing the position of the cam followers of the rotational rib member within their respective cam recess relative to the position of the engagement bosses within their respective engagement recess of the female connector at a point where the connectors are almost fully engaged.
Figure 4B:
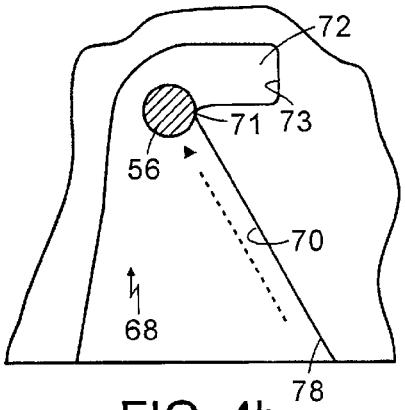

Referring to FIGS. 4A and 4B wherein the relative positions of the cam follower portions 46 within their corresponding cam recess 22 (FIG. 4A) and the engagement bosses 56 within their corresponding engagement recess 68 (FIG. 4B) are shown at a point where the male connector 12 and female connector 14 are almost fully telescopically engaged. At this point, the engagement bosses 56 are in contact with and positioned at the transition corner 71 of the first tapered wall 70 of the engagement recess 68 and each of the cam follower portions 46 are positioned at the outermost portion 30 of the cam recesses 22 adjacent the outermost end wall 32. In this position, bearing force applied by the first tapered wall 70 has caused the collar 36 to be rotated thereby causing the rotational ribs 44 to become elastically deformed and/or torsionally flexed thereby creating a counter-rotation force resisting the rotation of the collar 36.

Figure 5A:
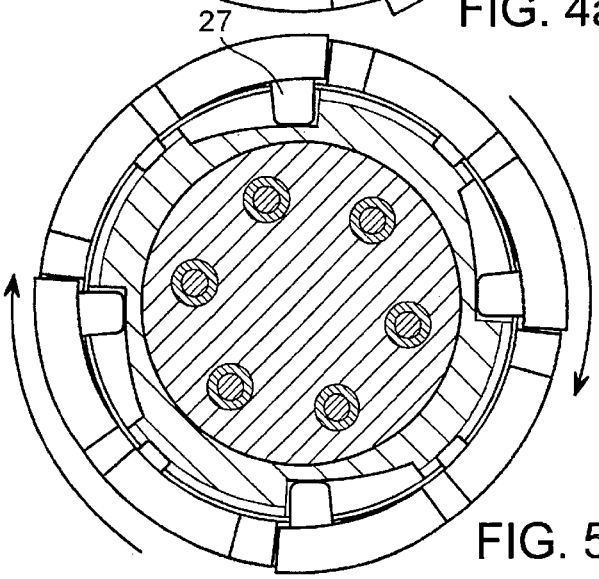
FIGS. 5A and 5B are diagrammatic views showing the position of the cam followers of the rotational rib members within their respective cam recess relative to the position of the engagement bosses which are forcibly engaged within the locking portion of the engagement recesses of the female connector at a point where the connectors are fully engaged.
Figure 5B:
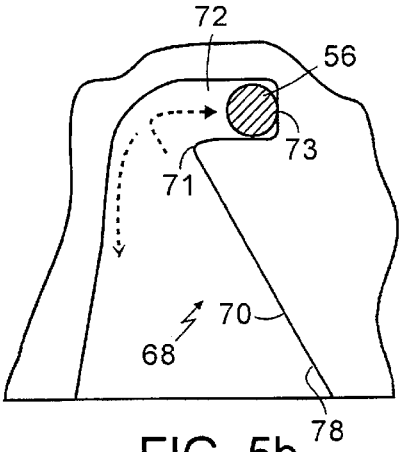

FIGS. 5A and 5B wherein the relative positions of the cam follower portion 46 within their corresponding cam recess 22 and the engagement bosses 56 within their corresponding engagement recess 68 are shown at a point where the male connector 12 and female 14 are fully engaged. At this point, each of the engagement bosses 56 have lost bearing contact with the first tapered wall 70 and as such, the counter-rotation force built-up within the elastically deformed rotational rib members 44 causes the engagement bosses 56 to be "snapped" or forcibly moved into enagement with the locking portion 72 and in contact with the end wall 73. Upon the occurrence of this full engagement, a "clicking noise"is emitted which lets the user know that full engagement and locking has occurred. Additionally, at this point, each of the cam follower portions 46 have returned substantially to the innermost portion 26 of the cam recesses 22 but are not in contact with the innermost end wall 28. As such, the rotational rib members 44 of the collar 36 are still slightly elastically deformed thereby still retaining and applying a continuing resistance (or counter-rotation force) to any rotation of the collar 36 due to incidental shock or vibration conditions that might tend to cause the engagement bosses 56 to rotate out of contact with the end wall 73 of the locking portion 72. In this regard, positioning of the end wall 73 point rotationally outward of the transition corner 71 and inward of the outermost portion 78 is important to ensure that upon full engagement of the male connector 12 and female connector 14, the rotational rib members 44 still retain and apply a residual counter-rotation force to forcibly retain the engagement bosses 50 within the locking portion 72 and against the end wall 73.

As can be seen, continued axial engagement of the connectors 12 and 14 causes the engagement bosses 56 to lose forced contact with the tapered wall projection 70 as the engagement bosses 56 pass beyond the transition corner 71 of the engagement recess 68. At this point, the engagement bosses 56 are forcibly moved to rotate into the locked portion 72 of the engagement recess 68 and against the end wall 73. As the collar 36 rotates automatically, driven by the elastically deformed spring loaded ribs 44 exerting inward bearing forces on the cam follower portions 46, driving them to move sliding down the ramp 24 in the cam recess 22 to the innermost portion 26 adjacent to but not in contact with the innermost end wall 28. Rotation of the collar 36 is stopped by the engagement bosses 56 forced contact with the end wall 73 of the locking portion 72. This position of the cam followers 46 in the cam recess 22 maintains a continued low level elastic deformation of the rotational ribs 44. This continues to keep some spring loading on the cam followers 46 which provides for continued rotational resistance of the collar 36, thereby providing assurance against any incidental rotation (and possible unlocking of the connector assembly 10) due to outside influences such as shock or vibration in the connector environment.

To disengage the male and female connectors 12 and 14, an applied rotational force must be exerted on the collar 36 (by manually rotating the collar 36) to move the collar 36 to a position whereby the engagement bosses 56 are clear of the locked portion 72 and can be removed from the engagement recesses 68. Disengagement of the connector bodies 12 and 14 is further assisted as the engagement bosses 56 are counter-rotated to the position that they encounter the curved wall 81 of the engagement recess 68 which as counter-rotation continues imparts a force initiating separation of the connector bodies 12 and 14 which is also applied as the bodes 12 and 14 separate by the engagement bosses 56 riding along the second tapered wall 82.

The foregoing description is intended primarily for purposes of illustration. This invention may be embodied in other forms or carried out in other ways without departing from the spirit or scope of the invention. Modification and variations still falling within the spirit or the scope of the invention will be readily apparent to those of skill in the art.

What is claimed is:

1. A connector system comprising:

(a) a first connector body comprising a housing and a collar, said housing comprising a longitudinal direction and a plurality of cam recesses, each of said cam recesses comprises an innermost portion and an outermost portion, said collar comprising a first end having at least one engagement boss and a second end having a plurality of rotational rib members which extend parallel with the longitudinal direction and are elastically deformable, each of said rotational rib members comprises a cam follower portion, said collar being resistingly rotatable around an outerside of said housing by said cam follower portions being slidingly moveably within corresponding said cam recesses from respective said innermost portions to respective said outermost portions of said cam recesses causing said rotational rib members to become increasingly elastically deformed;

(b) a second connector body comprising at least one engagement recess, said engagement recess comprises a tapered wall portion and a locking portion; and (c) said first connector body being telescopingly with said second connector body from a first position wherein said engagement boss is in contact with said tapered wall portion and said cam follower portions are positioned at respective said uppermost portions of respective said cam recesses to a second position wherein said engagement boss is not in contact with said tapered wall and is forcibly driven and locked within said locked portion.

2. The system of claim 1, wherein said collar comprises a plurality of axial retention rib member and said housing comprises a plurality of retention recesses whereby engagement of axial retention rib members within corresponding said retention recesses serve to fasten said collar to said housing and to restrain said collar from any axial motion with respect to said first connector while allowing unrestrained rotational freedom.

3. The system of claim 1, wherein said collar of said first connector member comprises a plurality of engagement bosses.

4. The system of claim 1, wherein said second connector body comprises a plurality of engagement recesses each having a tapered wall and a locking portion.

5. The system of claim 1, wherein said first connector member is a male type connector having a plurality of pins and wherein said second connector is a female type connector having a plurality of sockets.

* * * * *